US012637821B2

(12) United States Patent
Smith

(10) Patent No.: US 12,637,821 B2
(45) Date of Patent: May 26, 2026

(54) METHOD, SYSTEM AND APPARATUS FOR ASYMMETRIC FLOW GUIDANCE OF FISH

(71) Applicant: United States of America as Represented by The Secretary of the Army, Alexandria, VA (US)

(72) Inventor: David L Smith, Vicksburg, MS (US)

( * ) Notice: Subject to any disclaimer, the term of this patent is extended or adjusted under 35 U.S.C. 154(b) by 0 days.

(21) Appl. No.: 17/957,306

(22) Filed: Sep. 30, 2022

(65) Prior Publication Data

US 2024/0110354 A1 Apr. 4, 2024

(51) Int. Cl.
*E02B 8/08* (2006.01)

(52) U.S. Cl.
CPC ..... *E02B 8/085* (2013.01)

(58) Field of Classification Search
CPC ..... E02B 8/08; E02B 8/085; E02B 1/006
USPC ..... 119/219; 405/81–83
See application file for complete search history.

(56) References Cited

U.S. PATENT DOCUMENTS

| | | | | |
|---|---|---|---|---|
| 6,712,555 | B1 * | 3/2004 | Truebe | A01K 61/00 119/219 |
| 2006/0191458 | A1 * | 8/2006 | George | B63H 19/04 114/253 |
| 2009/0104828 | A1 * | 4/2009 | Krah | B63H 16/12 441/74 |

FOREIGN PATENT DOCUMENTS

| | | | | |
|---|---|---|---|---|
| CA | 3207886 | A1 * | 8/2022 | A01K 79/02 |
| FR | 2735442 | A1 * | 12/1996 | |
| GB | 2228960 | A * | 9/1990 | E02B 3/04 |

OTHER PUBLICATIONS

DE 102009044069 (Year: 2011).*

* cited by examiner

*Primary Examiner* — Sunil Singh

(57) ABSTRACT

An apparatus for guiding fish through a body of water having a water flow includes one or more hydrofoil element oriented in the body of water to produce an asymmetric flow field that has a fast, low turbulent flow on one side of the element and a slow, high turbulent flow on the other side of the element. Positively rheotactic fish have a preference for one side versus the other and so are guided in a desired direction. Systems and method that utilize the apparatus can be used to guide fish away from infrastructure such as dams, locks, levees, flood weirs, and other diversion points.

17 Claims, 7 Drawing Sheets

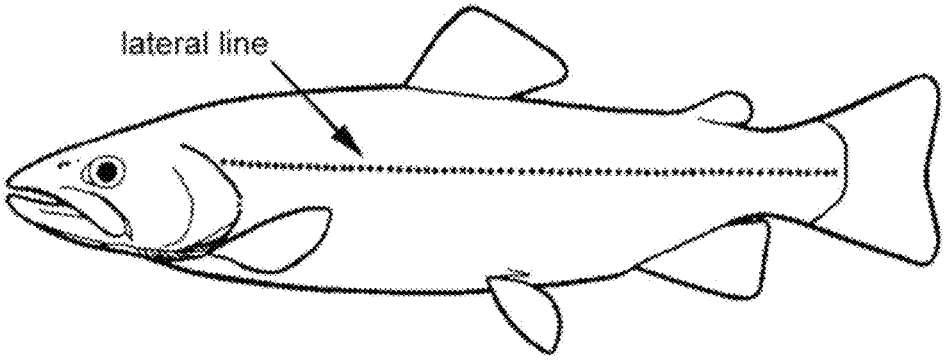
FIG. 1
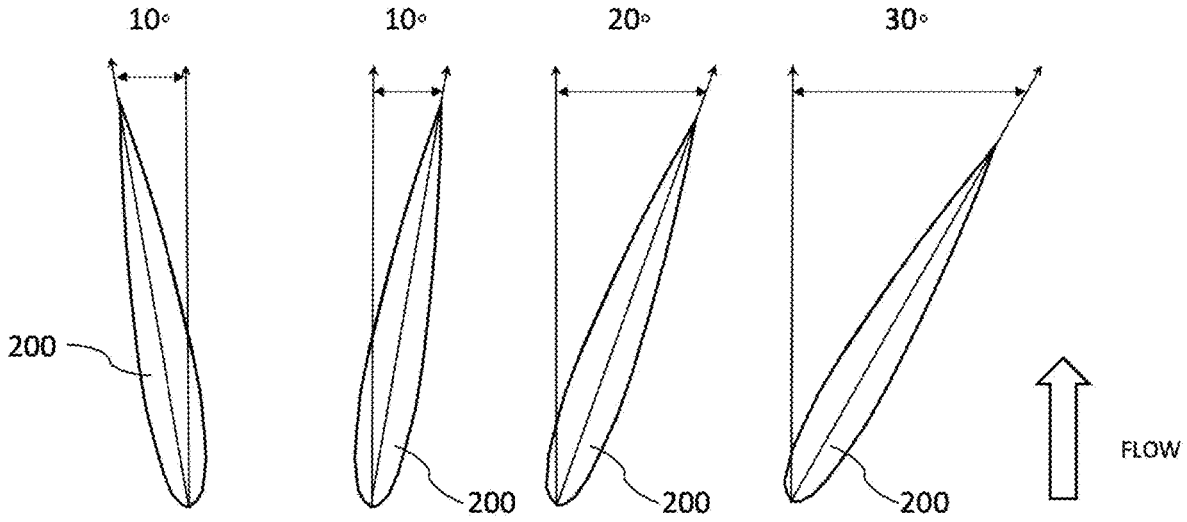
FIG. 2A
FIG. 2B
FIG. 2

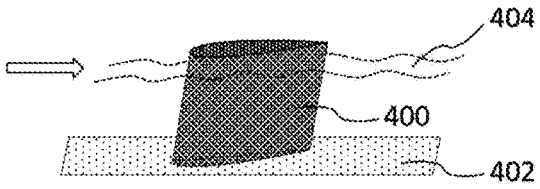
FIG. 4A
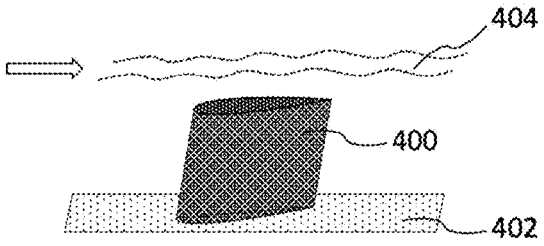
FIG. 4B
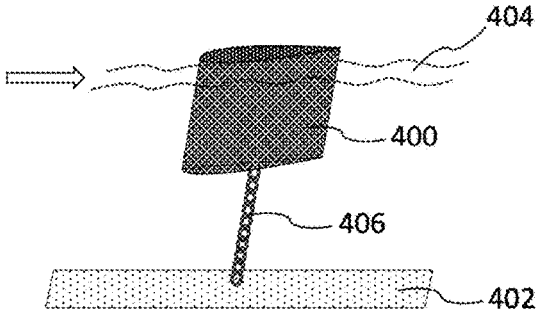
FIG. 4C
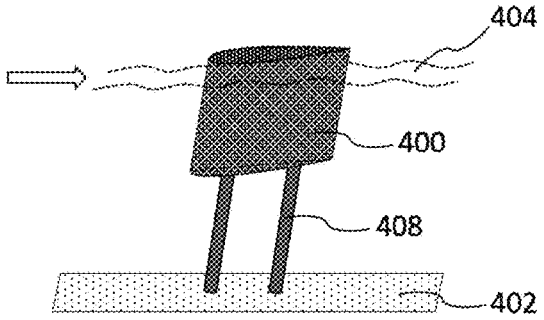
FIG. 4D
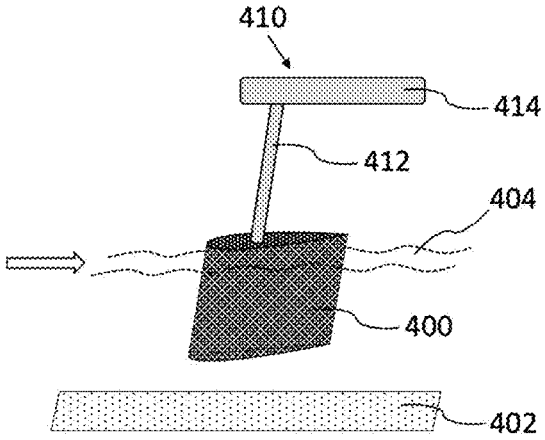
FIG. 4E
FIG. 4

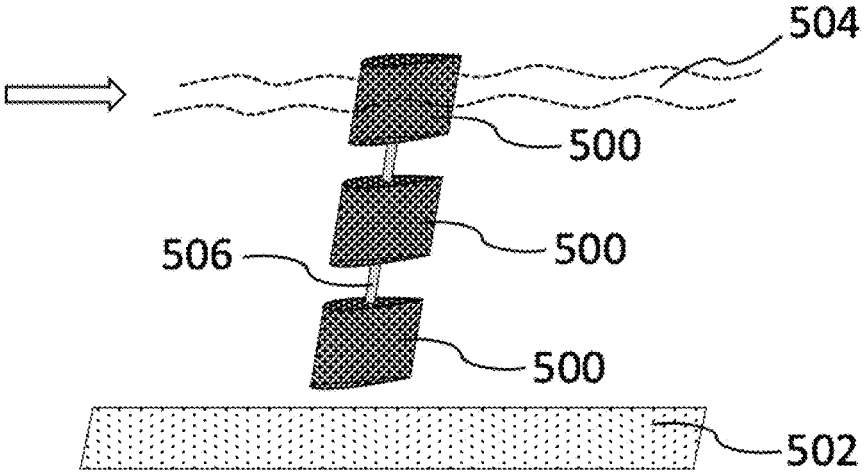
FIG. 5A
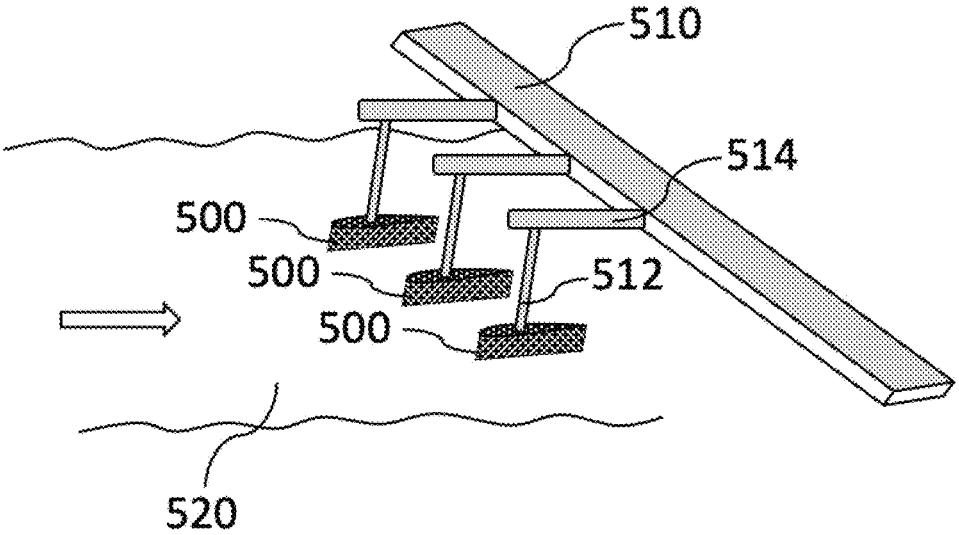
FIG. 5B
FIG. 5

METHOD, SYSTEM AND APPARATUS FOR ASYMMETRIC FLOW GUIDANCE OF FISH

GOVERNMENT INTEREST

The subject matter of this disclosure was made with support from the United States Army Corps of Engineers—Engineer Research and Development Center, Environmental Laboratory. The Government of the United States of America has certain rights in this invention.

TECHNICAL FIELD

The present disclosure relates to a fish guidance system for guiding fish through a body of water.

BACKGROUND

Infrastructure such as dams, locks, levees, flood weirs, and diversion points sometimes impact the movement of fish. Often part of the impact is related to the location in the river cross-section where fish approach the infrastructure in question. Increased fish passage success may be desirable but requires that the fish locate the passage location, or changes in the percentage of fish entraining into a diversion point may be desirable to meet management objectives.

Dams are one of the largest issues for sustaining riverine ecosystem connectivity. Mitigation of this issue requires new operations and sometimes new infrastructure, both of which are expensive to implement, construct, and operate. The effectiveness of the fish mitigation infrastructure is often related to its size with bigger structures and larger flows being more effective for fish but more costly for construction and maintenance. Guiding fish approaching a dam to a specific location would allow smaller infrastructure that is a more effective mitigation at reduced construction and engineering cost.

Fish hydro-navigate using a hydraulic sensor called a lateral line (FIG. 1). Lateral lines allow fish to sense hydraulic conditions on each side of the body. This ability is common to almost all fish including economically important native, nonnative, and invasive fishes in rivers of the United States. This sensing ability allows fish to sense and respond to asymmetric hydraulic stimuli and make movement decisions that facilitate migration and movement toward behavioral outcomes that improve fitness over the long term. Thus, in nature, asymmetric flow fields provide information that fish can interpret to make movement decisions.

The lateral line, also called the lateral line organ (LLO), is a system of sensory organs found in fish, used to detect movement, vibration, and pressure gradients in the surrounding water. The sensory ability is achieved via modified epithelial cells, known as hair cells, which respond to displacement caused by motion and transduce these signals into electrical impulses via excitatory synapses. Lateral lines serve an important role in schooling behavior, predation, and orientation. Fish can use their lateral line system to follow the vortices produced by fleeing prey. Lateral lines are usually visible as faint lines of pores running lengthwise down each side, from the vicinity of the gill covers to the base of the tail.

The development of an asymmetric flow field using hydrofoil structures having two distinct hydraulic states unique to one side or the other is a method to guide fish toward or away from specific locations in a body of water. If the hydrofoils are paired with structures such as fish ladders, fish lifts, locks, or other infrastructure intended to pass fish then the overall ability of fish to find the infrastructure is increased allowing for higher effectiveness and refined engineering to size the structure for reducing cost and increasing effectiveness. Moreover, invasive species such as invasive carp may be concentrated in one region and targeted for other management actions such as removal.

SUMMARY

One aspect of the present disclosure relates to an apparatus for guiding fish through a body of water having a water flow. Various embodiments of the apparatus include one or more hydrofoil element oriented in the body of water to produce an asymmetric flow field that includes a fast, low turbulent flow on one side of the element and a slow, high turbulent flow on the other side of the element. In some embodiments, the hydrofoil is oriented at an acute angle to the water flow direction, and an anchoring device is configured to secure the hydrofoil at a desired position in the water flow.

Another aspect of the present disclosure relates to a system for guiding fish through a body of water. Various embodiments of the system include a body of water having a water flow, and one or more apparatus for guiding fish through the body of water. The apparatus includes one or more hydrofoil element oriented in the body of water to produce an asymmetric flow field that includes a fast, low turbulent flow on one side of the element and a slow, high turbulent flow on the other side of the element. Fish in the body of water react to the asymmetric flow field and are guided to swim toward the fast, low turbulent flow.

Another aspect of the present disclosure relates to a method of guiding fish through a body of water having a water flow. Various embodiments of the method include positioning one or more hydrofoil element oriented in the body of water to produce an asymmetric flow field that includes a fast, low turbulent flow on one side of the element and a slow, high turbulent flow on the other side of the element. Fish in the body of water react to the asymmetric flow field and are guided to swim toward the fast, low turbulent flow.

BRIEF DESCRIPTION OF THE DRAWINGS

FIG. 1 is a diagram of a fish, showing the lateral line.

FIG. 2A and FIG. 2B are plan view diagrams of a hydrofoil element according to various embodiments of the disclosure. The hydrofoil elements are oriented at a desired direction and angle with regard to the direction of the flow of water. In FIG. 2A, the hydrofoil element is oriented to the left at a 10° angle to the flow of water (arrow). In FIG. 2B, the hydrofoil element is oriented to the right at 10°, 20°, and 30° to the flow of water.

FIG. 4A, FIG. 4B, FIG. 4C, FIG. 4D, and FIG. 4E are isometric view diagrams of an apparatus according to various embodiments of the disclosure.

FIG. 5A and FIG. 5B are isometric view diagrams of an apparatus according to various embodiments of the disclosure.

DETAILED DESCRIPTION

While the present disclosure will be described in conjunction with specific embodiments, the disclosure can be applied to a wide variety of applications, and the description herein is intended to cover alternatives, modifications, and equivalents within the spirit and scope of the disclosure and the claims. The description in the present disclosure should not be viewed as limiting or as setting forth the only embodiments of the disclosure, as the disclosure encompasses other embodiments not specifically recited herein. The present disclosure is directed toward all novel and non-obvious features and aspects of the various disclosed embodiments. Any theories of operation are to facilitate explanation, but the disclosed methods and devices are not limited to such theories of operation.

According to various embodiments of the present disclosure, an apparatus for guiding fish through a body of water includes one or more hydrofoil element that is configured to provide an asymmetric flow field in the water, with a fast, smooth, low turbulent flow on one side of the element and a slower, higher turbulent flow on the other side of the element. Various embodiments of the apparatus also include an anchoring device configured to secure the hydrofoil element at a desired position and orientation in the water flow.

As shown in FIG. 2A-2B, in various embodiments the hydrofoil element 200 is oriented in the water at an acute angle to the direction of water flow (arrow) of the body of water. In various embodiments, the hydrofoil element 200 is oriented at an angle in a range of about 0°-90°, about 5°-45°, about 100-35°, about 100-30°, about 12.5°-30°, about 150-25°, or about 200 to the direction of the water flow. In various embodiments, the hydrofoil element 200 is oriented at an angle to the left of the water flow (FIG. 2A), and in other embodiments, the hydrofoil element 200 is oriented at an angle to the right of the water flow (FIG. 2B).

In various embodiments, the hydrofoil element 200 has a symmetric shape or about a symmetric shape, in a transverse cross section. The two sides of the hydrofoil element 200 have an identical or substantially identical curvature. Because of the angled orientation in the water, the hydrofoil element 200 produces an asymmetric flow field, with a fast, low turbulent flow on one side and a slower, higher turbulent flow on the other side.

Figure 3:
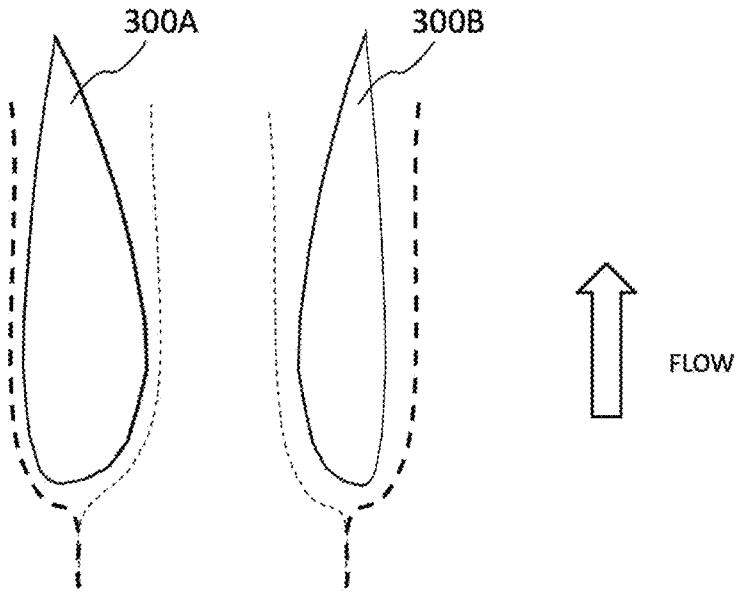
FIG. 3 are plan view diagrams of a hydrofoil element according to various embodiments of the disclosure. The hydrofoil element is asymmetric, having different curvature on the two sides, and produces an asymmetric flow field, shown by the strength of the dashed lines.

In some embodiments, illustrated in FIG. 3, the hydrofoil elements 300A and 300B have an asymmetric shape, in the transverse cross section direction, and the two sides of the hydrofoil element have different curvature. Embodiments of such asymmetric hydrofoil elements 300A and 300B also provide an asymmetric flow field, with a fast, low turbulent flow on one side of the element (heavier dashed line) and a slower, higher turbulent flow on the other side (lighter dashed line). Embodiments of the asymmetric hydrofoil elements 300A and 300B provide an asymmetric flow field even when oriented at an angle of less than 5°, or an angle of about 0°, to the direction of the water flow.

According to various embodiments, the apparatus includes an anchoring device configured to secure the hydrofoil element at a desired position in the water flow. FIG. 4A-4E illustrate several exemplary embodiments of the anchoring device and its configuration according to the present disclosure. In FIG. 4A-4D, the hydrofoil element 400 is anchored to the bottom of the body of water 402, for example to the river bottom. In FIG. 4A, the hydrofoil element 400 spans the entirety or substantially the entirety of the water depth, i.e., from the bottom 402 to the water surface 404. In FIG. 4 B, the hydrofoil element 400 spans only a portion of the water depth, i.e., the top surface of the hydrofoil element 400 remains submersed under the water surface 404. According to various embodiments, the hydrofoil is anchored to the bottom of the body of water by any means of securement, such as pylons or bolts.

In FIG. 4C, an embodiment of the hydrofoil element 400 is secured to the body of water bottom 402 by a cable or chain 406. Various embodiments of the hydrofoil element 400 are buoyant and float upwards toward the water surface 404. Embodiments of the hydrofoil element 400 break the water surface 404 and have a buoyancy that maintains a desired amount of hydrofoil element above the water surface. Some embodiments have a cable or chain length that maintains the buoyant hydrofoil element at a desired depth below the water surface. In some embodiments, the hydrofoil element is buoyant in water. In some embodiments, the apparatus further includes a buoyancy element configured to flotate the hydrofoil element. Various embodiments of the buoyancy element are configured to flotate the hydrofoil element at a desired depth in the water.

In FIG. 4D, an embodiment of the hydrofoil element 400 is secured to the body of water bottom by one or more support member 408. Embodiments of the support member 408 are securely sunk into the bottom 402 of the body of water. In various embodiments, the one or more support member 408 maintains the hydrofoil element 400 at a desired depth, such as below or breaking above the water surface 404.

According to various embodiments, the anchoring device is configured to secure the hydrofoil element from above the surface of the body of water. In FIG. 4E, an embodiment of the apparatus includes an above water anchoring device 410 with attachment arms 412 and 414 secured to the hydrofoil element 400. In various embodiments, the above water anchoring device 410 maintains the hydrofoil at a desired depth, such as below or breaking above the water surface 404. In various embodiments, one or more of attachment arms 412 and 414 is adjustable to adjust the depth of the hydrofoil element 400 in the water, or to remove the hydrofoil element 400 from the water.

According to various embodiments, the apparatus includes a plurality of hydrofoil elements 500. FIG. 5A-5B illustrate embodiments of the apparatus that include three hydrofoil elements 500. In FIG. 5A, three hydrofoil elements 500 are stacked and positioned vertically in the water with support attachment members 506. In various embodiments, each of the three hydrofoil elements 500 is positioned at a different water depth from the bottom 502 and water surface 504.

In FIG. 5B, three hydrofoil elements 500 are secured from above with an above water anchoring device 510. In various embodiments, the three hydrofoil elements 500 are positioned laterally across the water flow. In some embodiments, the above water anchoring device 510 spans across a portion or an entirety of the body of water 520, and includes attachment arms 512 and 514.

According to various embodiments of the present disclosure, a system for guiding fish through a body of water includes a body of water having a water flow, and one or more apparatus for guiding fish through the body of water, as disclosed herein. In various embodiments of the system, the apparatus includes one or more hydrofoil element oriented in the body of water at an acute angle to the water flow direction, and an anchoring device configured to secure the hydrofoil element at a desired position in the water flow. The hydrofoil element is oriented to produce an asymmetric flow field that has a fast, low turbulent flow on one side of the hydrofoil element and a slower higher turbulent flow on the other side of the hydrofoil element. The fish in the body of water react to the asymmetric flow field and are guided to swim toward the fast, low turbulent flow.

According to various embodiments of the system, the body of water is a river or stream. In some embodiments, the body of water contains a dam, and the system is configured to guide the fish in a direction away from the dam. In some embodiments, the body of water contains a bypass, such as dam bypass, and the system is configured to guide the fish in a direction toward and/or into the bypass. In various embodiments, the fish are guided into the bypass, and the fish are then transported to a position upstream of the dam.

According to various embodiments, the system includes at least a first apparatus positioned in the body of water to produce a first asymmetric flow field, and at least a second apparatus positioned in the body of water to produce a second asymmetric flow field, wherein the first asymmetric flow field guides a first type of fish and the second asymmetric flow field guides a second different type of fish. In various embodiments, a first apparatus includes a hydrofoil oriented at a first angle to the water flow direction and producing a first asymmetric flow field that guides a first type of fish, and a second apparatus includes a hydrofoil oriented at a second angle to the water flow direction and producing a second asymmetric flow field that guides a second type of fish. Embodiments of the system separate and guide at least two types of fish.

According to various embodiments, the system includes a plurality of apparatuses arranged in a series. Embodiments include a first apparatus positioned in the body of water to produce a first asymmetric flow field, and at least a second apparatus positioned in the body of water to produce a second asymmetric flow field. The first flow field guides the fish or group of fish into a first swim trajectory, the second flow field guides the fish or group of fish into a second swim trajectory, thereby guiding the fish sequentially from one trajectory to another across the width of the body of water. Embodiments of the system include one or more apparatus positioned to guide fish a short distance or a long distance, depending on location specific needs.

According to various embodiments of the present disclosure, a method of guiding fish through a body of water having a water flow includes positioning one or more hydrofoil element oriented in the body of water to produce an asymmetric flow field that has a fast, low turbulent flow on one side of the element and a slow, high turbulent flow on the other side of the element. In various embodiments, the fish in the body of water react to the asymmetric flow field and are guided to swim toward the fast, low turbulent flow.

According to various embodiments of the method, the body of water is a river or stream. In some embodiments, the body of water contains a dam, and the method guides the fish in a direction away from the dam. In some embodiments, the body of water contains a bypass, such as a dam bypass, and the fish are guided in a direction toward and/or in to the bypass. In various embodiments of the method, the fish are guided in to the bypass and the fish are transported to a position upstream of the dam.

According to various embodiments of the method, a first hydrofoil element is positioned in the body of water to produce a first asymmetric flow field, and at least a second hydrofoil element is positioned in the body of water to produce a second asymmetric flow field, wherein the first asymmetric flow field guides a first type of fish and the second asymmetric flow field guides a second different type of fish. In various embodiments, a first hydrofoil is oriented at a first angle to the water flow direction, producing a first asymmetric flow field that guides a first type of fish, and a second hydrofoil is oriented at a second angle to the water flow direction, producing a second asymmetric flow field that guides a second type of fish. Embodiments of the method separate and guide at least two types of fish.

According to various embodiments of the method, a plurality of hydrofoil elements are arranged in a series. Embodiments include a first hydrofoil element positioned in the body of water to produce a first asymmetric flow field, and at least a second hydrofoil element positioned in the body of water to produce a second asymmetric flow field. The first flow field guides a fish or group of fish into a first swim trajectory, the second flow field guides the fish or group of fish into a second swim trajectory, thereby guiding the fish sequentially from one trajectory to another across the width of the body of water. Embodiments of the system include one or more hydrofoil element positioned to guide fish a short distance or a long distance, depending on location specific needs.

Figure 6:
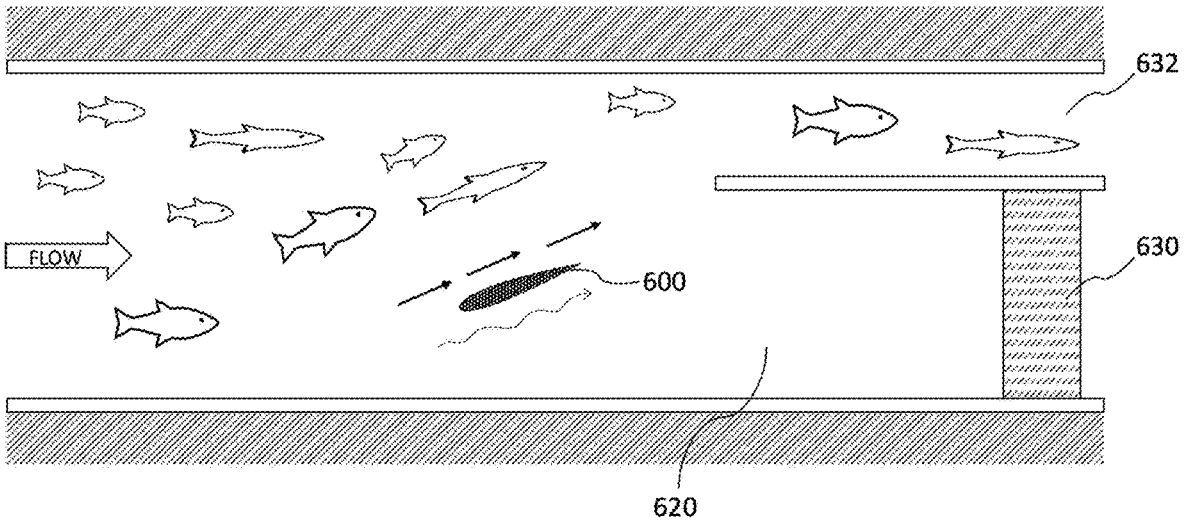
FIG. 6 illustrates a system and method for guiding fish through a body of water, according to various embodiments of the disclosure. The fish are guided away from infrastructure (dam) and toward a bypass.

FIG. 6-FIG. 9 illustrate various embodiments of the systems and methods according to the present disclosure. In FIG. 6, a hydrofoil element 600 is positioned in a body of water 620, for example a river. The body of water has a water flow with a direction shown by the arrow. The hydrofoil element 600 is positioned in the body of water 620 and oriented at an angle to the water flow direction, and is secured at that position. The hydrofoil element 600 produces an asymmetric flow field that has a fast, low turbulent flow on one side of the element (straight arrows), and a slower, higher turbulent flow on the other side of the element (winding arrow). Fish in the body of water react to the asymmetric flow field and swim toward the fast, low turbulent flow.

FIG. 6 also shows an embodiment of the system and method that includes a dam 630 and a dam bypass 632. Fish in the body of water 620 reacting to the asymmetric flow field are guided in a direction away from the dam 630 and toward the dam bypass 632.

Figure 7:
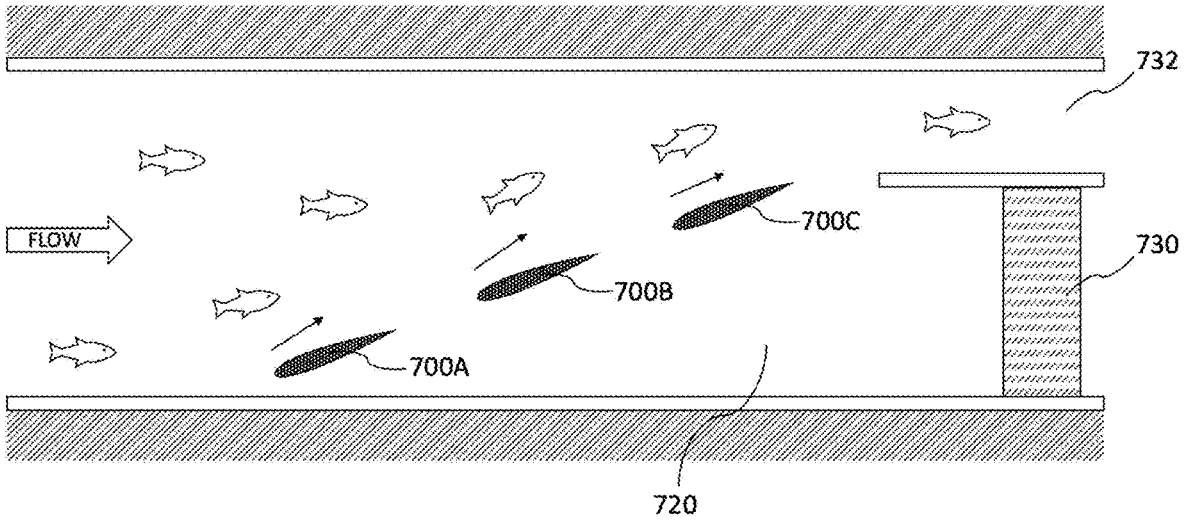
FIG. 7 illustrates a system and method for guiding fish through a body of water, according to various embodiments of the disclosure. The fish are guided away from infrastructure (dam) and toward a bypass.

FIG. 7 illustrates an embodiment of the system and method in which a plurality of hydrofoil elements 700A, 700B, and 700C are utilized to guide the fish. The hydrofoil elements are arranged in a series and are positioned to sequentially guide the fish across the width of the body of water 730. A first hydrofoil element 700A is positioned to produce a first asymmetric flow field that guides the fish into a first swim trajectory. A second hydrofoil element 700B is positioned to produce a second asymmetric flow field that guides the fish into a second swim trajectory, and a third hydrofoil element 700C is positioned to produce a third asymmetric flow field that guides the fish into a third swim trajectory. The series of hydrofoil elements sequentially guides the fish across the body of water, away from dam 730 and toward and/or in to the dam bypass 732.

Figure 8:
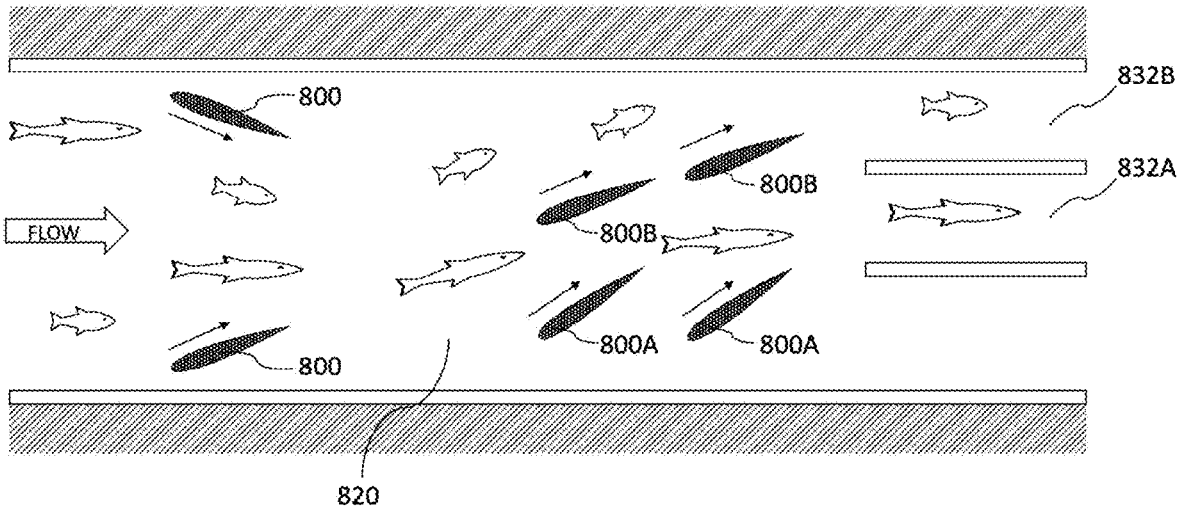
FIG. 8 illustrates a system and method for guiding fish, and separating different types of fish, according to various embodiments of the disclosure. The hydrofoil elements generate two different asymmetric flow fields, and the fish react differently.

FIG. 8 illustrates an embodiment of the system and method that includes positioning a plurality of hydrofoil elements 800, 800A, and 800B in the body of water 820. The hydrofoil elements 800, 800A, and 800B are configured and oriented in the body of water 820 to produce different asymmetric fields of flow. First hydrofoil elements 800 are positioned to guide fish in a desired trajectory, such as toward the center of the body of water 820. Second hydrofoil elements 800A and 800B produce different asymmetric fields of flow, which the different types of fish interpret and make different movement decisions. Embodiments of this system and method guide and separate different types of fish toward and/or into corresponding bypass areas 832A and 832B. In this embodiment, the hydrofoil element 800A is oriented at an angle to the water flow (e.g. 30°) and hydrofoil element 800B is oriented at a different angle to the water flow (e.g. 20°). Different types of fish react differently to the two asymmetric flow fields, for instance are more attracted to one flow field over the other, and are guided in a desired predictable manner. Embodiments of this system and method separate the different types of fish.

Figure 9:
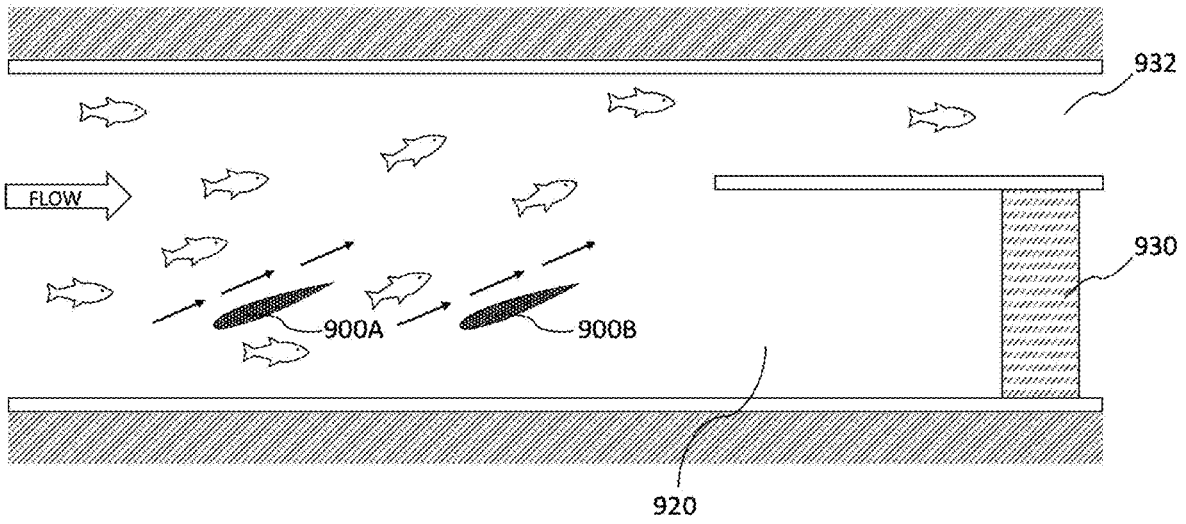
FIG. 9 illustrates a system and method for guiding fish through a body of water, according to various embodiments of the disclosure. A second hydrofoil element provides additional fish guidance.

FIG. 9 illustrates an embodiment of the system and method in which a plurality of hydrofoil elements 900A and 900B are utilized to guide the fish. In this embodiment, a first hydrofoil element 900A is oriented to guide the fish away from the dam 930 and toward the dam bypass 932. Embodiments of the system and method envision that not all fish are guided in the desired direction (i.e., toward the fast, low turbulent flow) and that some fish will swim past the hydrofoil element 900A in the non-desired direction (i.e., toward the slow, high turbulent flow), or after passing the hydrofoil element 900A will turn on a trajectory back toward the dam 930. According to various embodiments, a second hydrofoil element 900B is positioned in the body of water to capture the stray or misguided fish and guide them back in the desired direction, i.e., toward the dam bypass 932.

EXAMPLES

A hydrofoil provides an asymmetric flow field with a smooth, fast, low turbulent flow on one side and a slow, high turbulent flow on the other side. The experiment tested whether positively rheotactic fish would have a preference for one side of the hydrofoil versus the other.

The experimental domain was a 40 ft long, 8 ft wide, and 4 ft deep channel set to nominally one fish body length per second or 50 cm/s mean water velocity, measured at the channel centroid without the hydrofoil in place.

Figure 10:
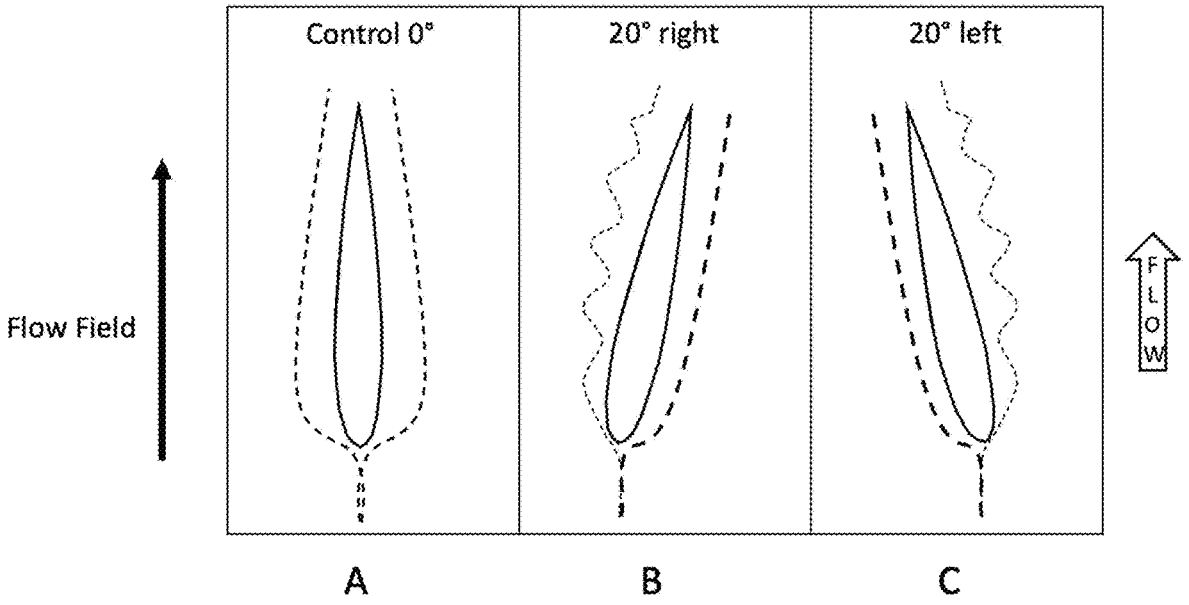
FIG. 10 are plan view diagrams of embodiments of hydrofoil elements utilized in an experimental example described in the disclosure.

The hydrofoil was mounted in three positions, as illustrated in FIG. 10: (A) parallel with the mean flow (control), (B) tilted 20 degrees to the right of the mean flow field, and (C) 20 degrees to the left of the mean flow field. For each condition, fish were acclimated in a section of the channel downstream of the hydrofoil. Fish could freely move across the width and depth of the channel. After 15 minutes a confining gate was lifted and the fish volitionally exited. The trial was complete when the fish reached the upstream gate. The time to travel the channel length was measured and recorded. The fish swim tracks were recorded via video and used to compute the percentages of each replicate that swam past the hydrofoil on one side or the other.

Six replicates of three fish each were swimming for each hydrofoil position. For the control, 50% of the fish passed the hydrofoil on the left and 50% passed the hydrofoil on the right. For both the right 20 degrees and left 20 degrees tilted hydrofoil, 5 of 6 groups, or approximately 83%, passed on the fast smooth side of the hydrofoil where velocities were highest and turbulence was lowest (heavy dashed line).

It is to be understood that where the claims or specification refer to "a" or "an" element, such reference is not to be construed that there is only one of the element. If the specification or claims refer to "an additional" element, that does not preclude there being more than one of the additional element.

It is to be understood that where reference is made herein to a method or process that includes two or more defined steps, the defined steps can be carried out in any order or simultaneously (except where context excludes that possibility), and the process can also include one or more other steps which are carried out before any of the defined steps, between two of the defined steps, or after all of the defined steps (except where context excludes that possibility). Methods of the disclosure may be implemented by performing or completing manually, automatically, or a combination thereof, selected steps or tasks.

For purposes of the disclosure, the term "at least" followed by a number is used herein to denote the start of a range beginning with that number (which may be a range having an upper limit or no upper limit, depending on the variable being defined). For example, "at least 1" means 1 or more than 1. Terms of approximation, such as "about," should be interpreted according to their ordinary and customary meanings as used in the associated art unless indicated otherwise. Absent a specific definition and absent ordinary and customary usage in the associated art, such terms should be interpreted to be ±10% of the base value.

When a range is given as "(a first number) to (a second number)" or "(a first number)–(a second number)" this means a range whose lower limit is the first number and whose upper limit is the second number. For example, 25 to 100 or 25-100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

While inventive concepts have been described and illustrated herein by reference to certain embodiments, various changes and further modifications may be made by those of ordinary skill in the art without departing from the spirit of the inventive concept, the scope of which is to be determined by the following claims.

What is claimed is:

1. A system for guiding fish through a body of water selected from the group consisting of a river and a stream, said body of water further comprising, a dam and a bypass, the system comprising:

said river or stream having a water flow; and at least a first hydrofoil apparatus and a second hydrofoil apparatus located in said body of water at a distance from said dam and for guiding fish through the body of water and approaching said dam from a distance, guiding the fish in a direction away from the dam and guiding the fish in a direction toward and/or into the bypass, wherein the first hydrofoil apparatus and the second hydrofoil apparatus are oriented in the body of water to produce an asymmetric flow field comprising a fast, low turbulent flow on one side of the first hydrofoil apparatus and the second hydrofoil apparatus and a slow, high turbulent flow on the other side of the first hydrofoil apparatus and the second hydrofoil apparatus, wherein fish in the body of water react to the asymmetric flow field and are guided to swim toward the fast, low turbulent flow, wherein the first hydrofoil apparatus and the second hydrofoil apparatus have a convex curvature on both sides of the apparatus, in a transverse cross section.

2. The system of claim 1, comprising an arrangement wherein said at least first hydrofoil apparatus a second hydrofoil apparatus are in series, the first hydrofoil apparatus positioned in the body of water to produce a first asymmetric flow field and the at least second hydrofoil apparatus positioned in the body of water to produce a second asymmetric flow field, wherein the first asymmetric flow field guides fish into a first swim trajectory and the second asymmetric flow field guides fish into a second swim trajectory, thereby guiding the fish sequentially from said first swim trajectory to said second swim trajectory across the width of the body of water.

3. The system of claim 1, wherein the fish are guided in a direction away from the dam.

4. The system of claim 3, wherein the fish are guided in a direction toward and/or in to the dam bypass.

5. The system of claim 1, wherein the at least first and second hydrofoil apparatus are each selected from the group consisting of a symmetric shape in a transverse cross section and an asymmetric shape in a transverse cross section.

6. The system of claim 1, wherein the at least first and second hydrofoil apparatus are each oriented in the body of water at an angle selected from the group consisting of an acute angle to the direction of the water flow, an angle in a range of about 10° to 30° to the water flow and an angle in a range of about 0° to 5° to the water flow.

7. The system of claim 1, wherein the at least a first hydrofoil apparatus and the at least a second hydrofoil apparatus are anchored to the bottom of the body of water to maintain their orientation.

8. The system of claim 1, wherein each of the at least a first hydrofoil apparatus and the at least a second hydrofoil apparatus has a shape, in a transverse cross section, wherein a center line from a first tangent point at a front tip of the hydrofoil apparatus to a second tangent point at a back tip of the hydrofoil apparatus is a straight line.

9. A system for guiding at least a first type of fish and a second type of fish, said at least first and second type of fish being different, through a body of water selected from the group consisting of a river and a stream, said body of water further comprising a dam and a bypass, the system comprising:

said river or stream having a water flow; and at least a first hydrofoil apparatus and a second hydrofoil apparatus located in said body of water at a distance from said dam and for guiding said at least a first and a second type of fish through the body of water and approaching said dam from a distance, wherein the first hydrofoil apparatus and the second hydrofoil apparatus are oriented in the body of water to produce a first asymmetric flow field comprising a fast, low turbulent flow on one side of the first hydrofoil apparatus and a slow, high turbulent flow on the other side of the first hydrofoil apparatus and a second asymmetric flow field comprising a fast, low turbulent flow on one side of the second hydrofoil apparatus and a slow, high turbulent flow on the other side of the second hydrofoil apparatus, said first asymmetric flow field being different from said second asymmetric flow field, wherein the first asymmetric flow field guides said first type of fish and the second asymmetric flow field guides-said second different type of fish, and separating and guiding said at least first and second types of fish, wherein the first hydrofoil apparatus and the second hydrofoil apparatus have a convex curvature on both sides of the apparatus, in a transverse cross section.

10. The system of claim 9, wherein the first type of fish is guided in a direction away from the dam.

11. The system of claim 9, wherein the second type of fish is guided in a direction away from the dam.

12. The system of claim 9, wherein the first type of fish is guided in a direction toward and/or in to the dam bypass.

13. The system of claim 9, wherein the second type of fish is guided in a direction toward and/or in to the dam bypass.

14. The system of claim 9, wherein the at least first and second hydrofoil apparatus are each selected from the group consisting of a symmetric shape in a transverse cross section and an asymmetric shape in a transverse cross section.

15. The system of claim 9, wherein the at least first and second hydrofoil apparatus are each oriented in the body of water at an angle selected from the group consisting of an acute angle to the direction of the water flow, an angle in a range of about 10° to 30° to the water flow and an angle in a range of about 0° to 5° to the water flow.

16. The system of claim 9, wherein the at least a first hydrofoil apparatus and the at least a second hydrofoil apparatus are anchored to the bottom of the body of water to maintain their orientation.

17. The system of claim 9, wherein each of the at least a first hydrofoil apparatus and the at least a second hydrofoil apparatus has a shape, in a transverse cross section, wherein a center line from a first tangent point at a front tip of the hydrofoil apparatus to a second tangent point at a back tip of the hydrofoil apparatus is a straight line.

* * * * *